United States Patent [19]

Wiles

[11] Patent Number: 4,619,075

[45] Date of Patent: Oct. 28, 1986

[54] HORIZONTAL SLIDING DOOR

[75] Inventor: Vernon L. Wiles, Williamsport, Md.

[73] Assignee: Jamison Door Company, Hagerstown, Md.

[21] Appl. No.: 652,091

[22] Filed: Sep. 19, 1984

[51] Int. Cl.[4] ..... E05D 15/56
[52] U.S. Cl. ..... 49/235; 49/410
[58] Field of Search ..... 49/234, 235, 409

[56] References Cited

U.S. PATENT DOCUMENTS

| | | | |
|---|---|---|---|
| 2,486,339 | 10/1949 | Stone | 49/235 X |
| 3,276,166 | 10/1966 | Markus . | |
| 3,611,637 | 10/1971 | Saino . | |
| 3,818,636 | 6/1974 | Calais et al. | 49/235 X |
| 4,404,770 | 9/1983 | Markus . | |

FOREIGN PATENT DOCUMENTS

| | | | |
|---|---|---|---|
| 2015066 | 9/1979 | United Kingdom | 49/409 |
| 1572638 | 7/1980 | United Kingdom | 49/235 |

OTHER PUBLICATIONS

Jamison Door Company, Mark II Door, public use in the United States about 1965.

*Primary Examiner*—Kenneth Downey
*Attorney, Agent, or Firm*—Cushman, Darby & Cushman

[57] ABSTRACT

A sliding door assembly is provided for closing an opening in a wall which prevents contact between the seal between the door and wall during horizontal sliding movement of the door, but provides for the door to move downwardly and inwardly at the end of its horizontal travel so as to effect sealing engagement between the door and wall. A track, including a pair of spaced contoured ramps, is provided connected to the wall adjacent the top of the door, and two V-shaped rollers are mounted to the top of the door and engage the track. The rollers are spaced from each other the same distance that the contoured ramps are spaced from each other. A bridge is provided at the rear contoured ramp. The rollers are asymmetrical, and of different hand, so that the leading roller engages the bridge at the second contoured ramp, but the trailing roller engages the second contoured ramp. The rollers are spaced apart a distance less than the width of the opening in the wall.

19 Claims, 8 Drawing Figures

HORIZONTAL SLIDING DOOR

BACKGROUND AND SUMMARY OF THE INVENTION

There are many applications for horizontal sliding doors wherein it is necessary to provide a tight sealing action between the door and the walls surrounding the opening that the door closes. In order to provide for such tight sealing action while preventing sliding friction between the door or wall and the sealing means (with subsequent quick degradation of the sealing elements), many conventional horizontal sliding doors utilize mechanisms for moving the door inwardly (toward the wall) and downwardly at the end of travel during the door closing action. This avoids frictional action on the sealing elements during the sliding action, but causes compression of the sealing elements between the door and wall upon final closing. Typical prior art arrangements for effecting this sealing action are shown in U.S. Pat. Nos. 3,276,166; 3,611,637; and 4,404,770.

According to the present invention, a sliding door assembly is provided which includes the desirable inward and downward movement of the door at the end of its horizontal path of movement in order to effect proper sealing, and the assembly according to the present invention accomplishes this desired result in a simple and advantageous manner. The assembly according to the present invention accomplishes the desired sealing action utilizing only two rollers for mounting the door on a track attached to the wall above the door. The two rollers are disposed within the projection of the width of the door, minimizing the size of the track, mounting, and like components.

The door assembly according to the present invention includes track means having first and second intersecting surfaces, the surfaces elongated in the horizontal direction of sliding of the door. The rollers, which are preferably V-shaped, have first and second surfaces thereof which cooperate with the first and second surfaces of the track. First and second contoured ramps are formed in the track. The first ramp is formed at the very leading edge of the track, and the second ramp is formed in the track at a distance spaced from the first ramp the same distance that the rollers are spaced from each other. At the second ramp a bridge is provided which provides a continuation of the first surface at the second ramp. The first and second ramps continuously move downwardly and inwardly while extending in the direction of horizontal sliding, so that when the rollers follow the ramp the desired end-of-travel sealing action results.

The leading roller has a longer first surface than the length of the first surface of the trailing roller. This means that when the leading roller approaches the second contoured ramp, the first surface thereof engages the bridge so that the leading roller does not follow the second contoured ramp. However the second roller, when it approaches the second contoured ramp, does not engage the bridge, so that it does follow the second contoured ramp (at the same time that the leading roller is following the first contoured ramp) so that the end of travel sealing action occurs.

It is the primary object of the present invention to provide a simple and effective sliding door assembly for closing an opening in a wall. This and other objects of the invention will become clear from an inspection of the detailed description of the invention, and from the appended claims.

DETAILED DESCRIPTION OF THE DRAWINGS

Figure 5:
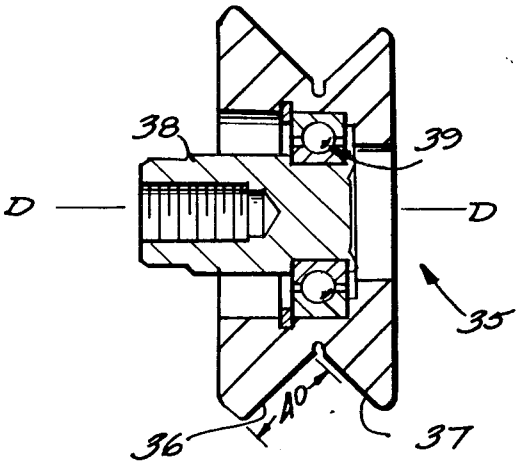
FIG. 5 is an end cross-sectional view of the leading roller of the door assembly of FIGS. 1 through 3.

The exemplary door assembly according to the present invention as illustrated in the drawings includes a door 10 for closing an opening 12 in a wall 14. The door 10 basically is of a conventional type, such as a conventional cooler, freezer, or fire door such as those manufactured by Jamison Door Company of Hagerstown, Md. The door 10 may also represent a single sliding door or the half of a double sliding door. Preferably sealing means are provided between door 10 and the wall 14 for effecting sealing of the opening 12, particularly in cooler, freezer, or fire control applications. While any desired conventional arrangement may be provided for the sealing (for example the sealing means may be mounted on the wall, door, or both), in the preferred embodiment illustrated in the drawings a sealing peripheral edge 16 of the door 10 cooperates with an elastomeric gasket 17 attached to the wall 14 and surrounding the opening 12. If desired the gasket 17 can be omitted at the bottom, and an elastomeric sealing element provided at the bottom of the door 10.

Figure 7:
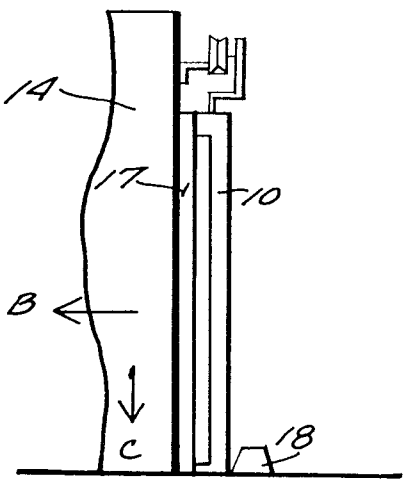
FIGS. 6 and 7 are end schematic views illustrating the inward and downward movement of the door to effect sealing at the end of travel thereof, an open position being illustrated in FIG. 6 and the closed position illustrated in FIG. 7.

According to the present invention means are provided for mounting the door 10 for sliding movement over a majority of a substantially linear length of travel thereof in a first direction A, which preferably is a horizontal direction in which the door moves from the open to the closed position thereof. The mounting means additionally mount the door 10 for movement in second and third directions —both perpendicular to the first direction and to each other—adjacent the end of the travel of the door in the first direction A, so as to provide the desired sealing action. The second direction B (see FIG. 1) is preferably inward (that is the horizontal direction toward the wall 14), while the third direction C is preferably downward. This downward and inward movement of the door to effect sealing at the end of its horizontal path of travel is illustrated schematically in FIGS. 6 and 7, the door moving from the open position illustrated in FIG. 6, in directions B and C, to the closed position as illustrated in FIG. 7. If necessary or desirable, guide cams 18 may be mounted on the floor adjacent the wall 14 to facilitate this action (see FIGS. 6 through 8).

The mounting means for mounting the door 10 include as the two major components thereof, track means and roller means.

The track means preferably comprise an elongated track 20 which includes first and second surfaces 21, 22, which surfaces intersect with other, and which are elongated in the direction A (see FIGS. 1 through 4). In the preferred embodiment illustrated in the drawings, the track 20 is shown as a diamond-shaped metal bar, threequarters of an inch on the side.

Formed as part of the track 20 at predetermined spaced positions along the direction A are first and second contoured ramps 24, 25, respectively. The ramps 24, 25 are provided above, and near the opposite ends of the opening 12 in the direction A. Each of the ramps contains surface portions which are continuations of the surfaces 21, 22, but that move gradually continuously in the directions B and C. For instance, see surfaces 121 and 122 which are continuations of the surfaces 21, 22 at first ramp 24, and surfaces 221 and 222 which are continuations of surfaces 21 and 22 at second ramp 25. The ramps eventually bottom out at the end terminations 26, 27, respectively, thereof.

At the second ramp 25, a bridge 30 is provided. The bridge 30 merely comprises a metal bar or the like that provides a continuation of the surface 21 (see FIGS. 1 and 4 in particular) that spans the length of the second ramp 25. In a typical construction, the track 20 and bar 30 are metal and are welded to each other.

Figure 1:
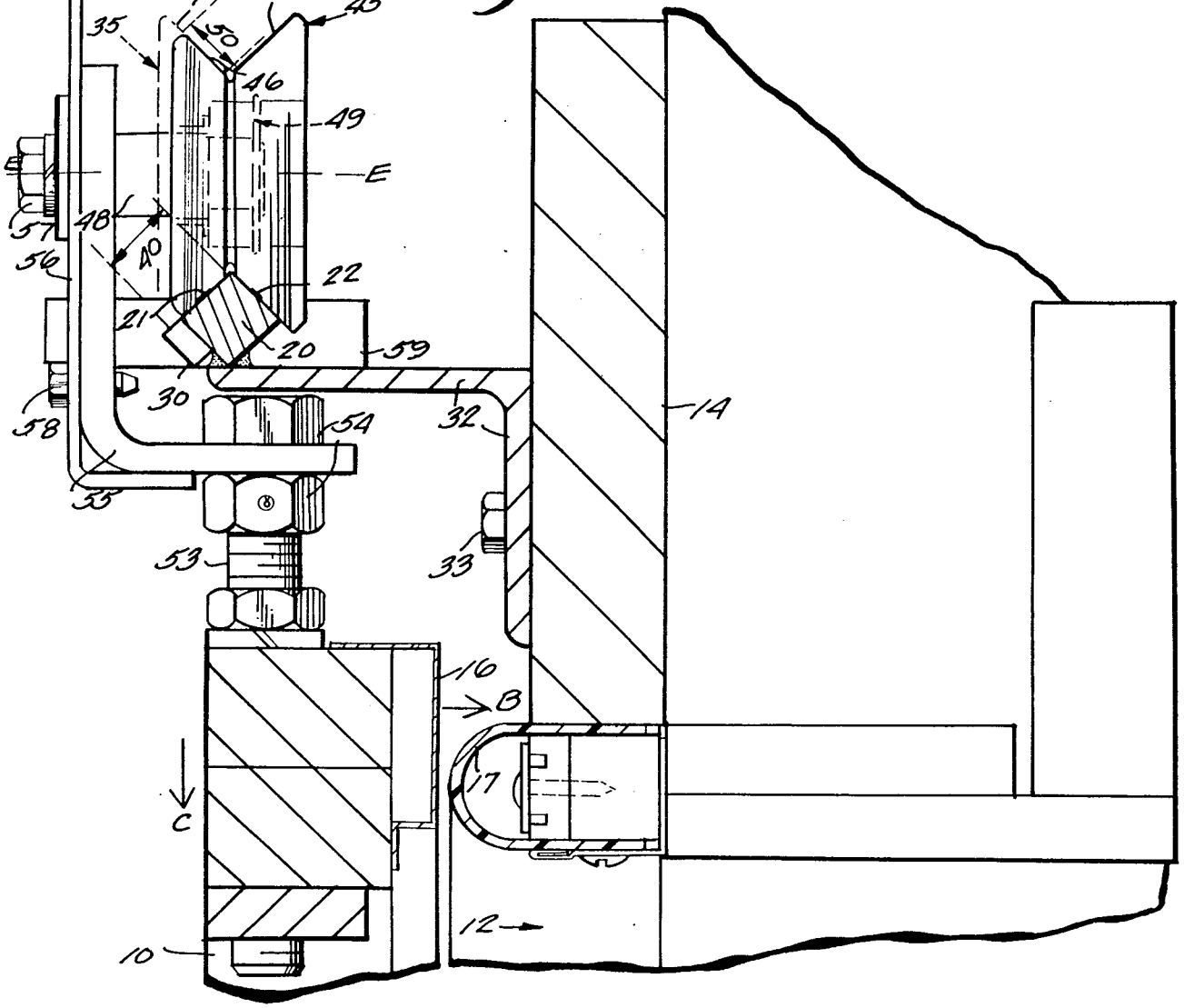
FIG. 1 is an end view, partly in cross-section and partly in elevation, of the mounting means of the door assembly according to the present invention illustrating the trailing roller of the mounting means in full line, and illustrating the contour of the leading roller in dotted line.

As illustrated most clearly in FIG. 1, preferably the track 20 is mounted above the opening 12 by the continuous angle iron bracket 32, which is held to the wall 14 at a number of spaced points along the length thereof by fasteners 33 or the like.

The second part of the mounting means for the door 10 comprises roller means, which preferably comprises first and second sets of rollers. The first set of rollers preferably comprises a V-shaped leading roller 35 (see FIGS. 2 and 5 in particular) having a first surface 36, and a second surface 37. The first surface 36 cooperates with the first track surface 21, and the second surface 37 cooperates with the second track surface 22. The roller 35 is mounted for rotation about an axis D—D, which is parallel to the direction B, and is defined by a shaft 38 or the like. Bearing means 39 are provided between the interior of the roller 35 and the shaft 39 to allow rotation about axis D—D. The length 40 of the surface 36 is greater than the normal length of the surface 37 so that when the leading roller 35 passes along the track 20 at the second ramp 25, the surface 36 will engage the bridge 30 (see FIGS. 1 and 2), and the roller 35 will not follow the contour of the ramp 25.

The second set of roller means preferably comprises a second, trailing roller 45 which has first and second surfaces 46, 47, respectively and is also V-shaped. Roller 45 is mounted for rotation about an axis E—E (see FIG. 1) which is parallel to the axis D—D, and is spaced from the axis D—D essentially the same distance as the spacing between corresponding portions of the ramps 24, 25. Shaft 48 and bearing 49 mount the roller 45 for rotation about axis E—E. Note that the first surface 46 of the roller 45 has a length 50 which is significantly less than the length 40, and in fact less than the width of the track surface 21 so that (as illustrated in FIG. 1) when the roller 45 approaches the second track 25, surface 46 will not engage the bridge 30, so that the roller 45 will follow the contour of the ramp 25.

Figure 2:
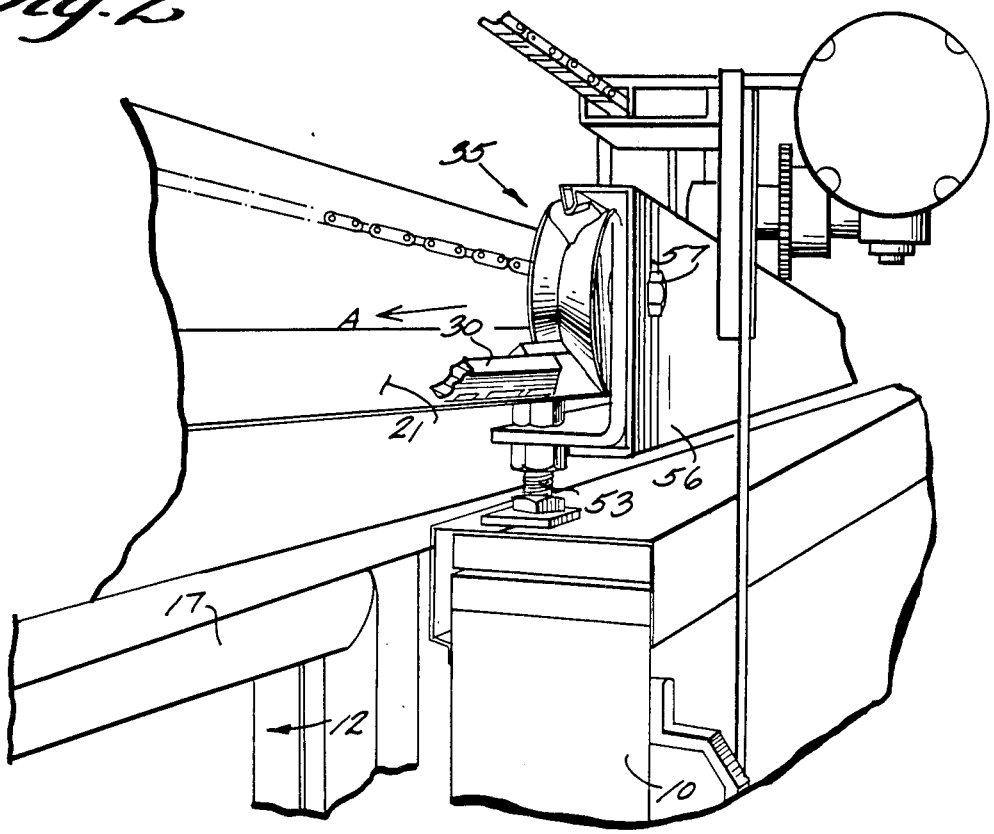
FIG. 2 is a perspective detail view of the leading edge and roller of the door of FIG. 1 in the position of the door just before it starts its horizontal sliding motion to move from the open to the closed positions.
Figure 3:
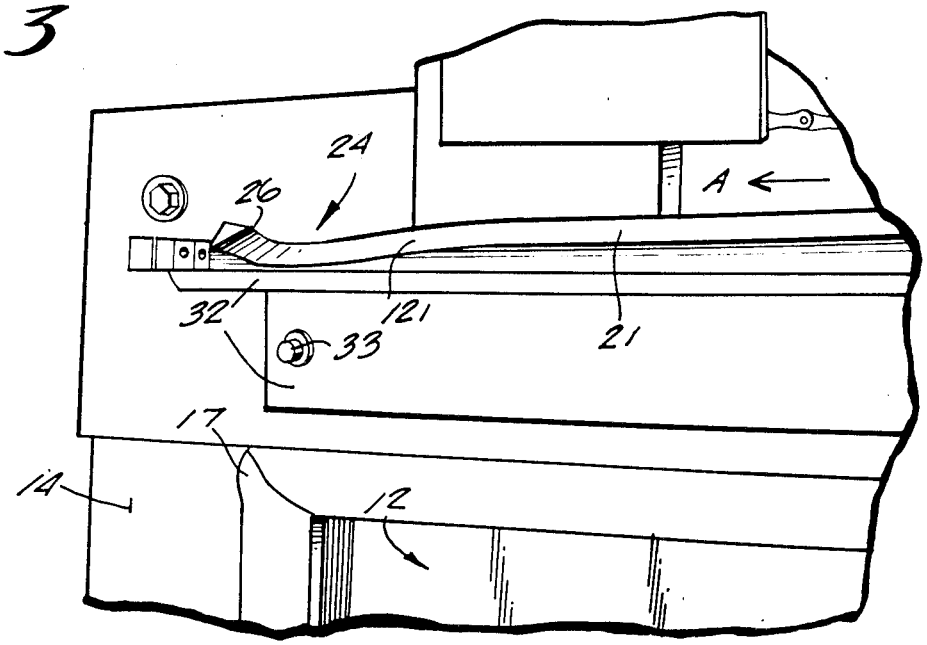
FIG. 3 is a detail perspective view of the leading end of the track of the door assembly of FIGS. 1 and 2.

As illustrated in FIGS. 1 and 2, preferably the rollers 35, 45 are mounted to the top of the door 10 by hanger rod 53, nuts 54, angle 55, carrier 56, fastener 57, self tapping screws 58, and like components. The carrier 56 is adapted to engage the metal stop 59 which is welded to the angle 32 at one end thereof to stop the door as it is slid to the open position (in the direction opposite to the direction A) so that the rollers 35, 45 do not go off the track 20.

For ease of construction of the components, it is desirable that the rollers 35 and 45 be identical, having asymmetrical surfaces 36, 37 or 46, 47 depending upon the orientation of the roller. The only differences between the roller 35 and the roller 45 illustrated in FIG. 1 is the disposition of the roller with respect to the angle 55. For the roller 35 the shaft 38 extends outwardly from the large diameter side thereof, while for the roller 45 the shaft 48 extends outwardly from the small diameter side thereof. Although it is highly desirable to have the rollers 35, 45 have the same interior diameter, the length of both of the surfaces 36, 37 of the leading roller 35 could be the length 40, and the length of both of the surfaces 46, 47 of the trailing roller 45 could be the length 50.

Figure 8:
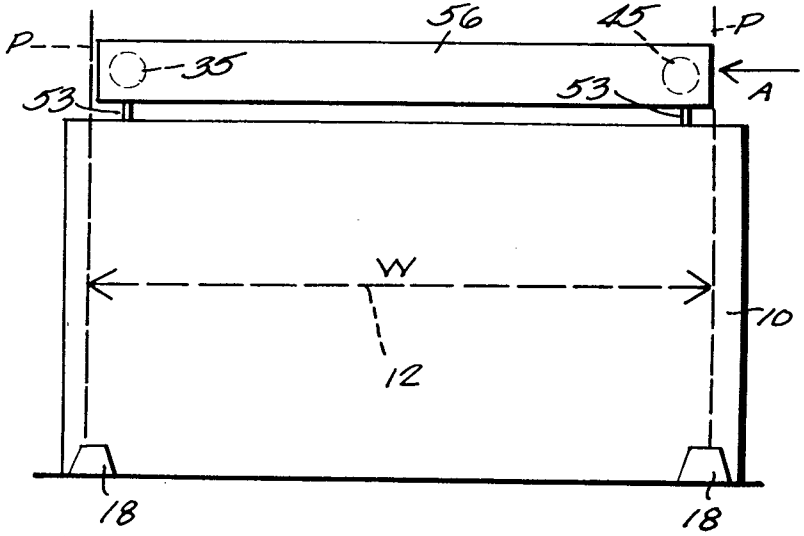
FIG. 8 is a schematic exterior side view of the door of FIGS. 1, 2, 6, and 7, illustrating the mounting of the rollers therefor within a projection of the width of the opening adapted to be closed by the door.

As can be readily seen with reference to FIGS. 2 and 8 in particular, because of the construction of the track and rollers according to the present invention, both rollers 35, 45 can be mounted within the projection line P of the width of the opening 12, and the length of the track 20 can be minimized.

While the invention has been described with reference to the drawings wherein the track 20 is a diamond-shaped component, and the rollers 35, 45 are V-shaped, it is to be understood that the basic features of the invention may be utilized with rollers and tracks of different shape and configuration, such as the roller and track shapes and configurations illustrated in Pat. Nos. 3,276,166, 3,611,637, and 4,404,770.

Operation

Figure 4:
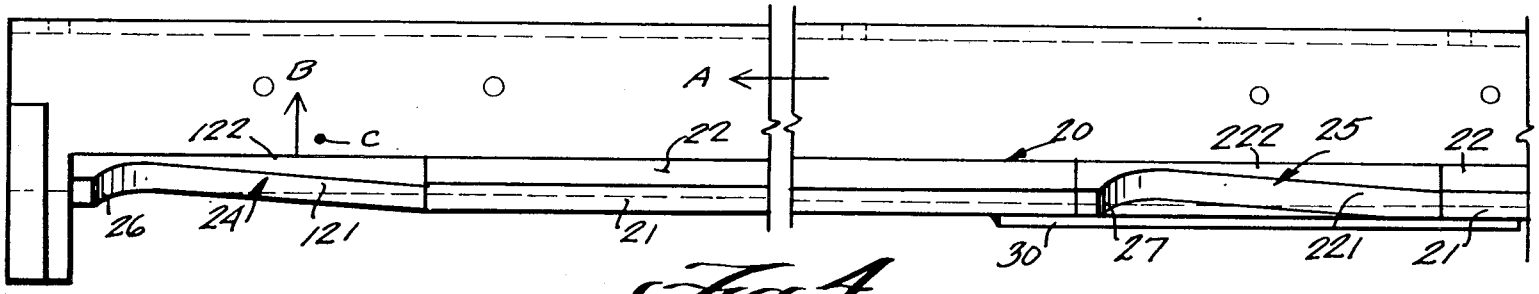
FIG. 4 is a top plan view, with portions cut away for ease of illustration, of the track of the door assembly of FIGS. 1 through 3.

An exemplary structure according to the invention having been described, an exemplary manner of operation thereof will now be set forth:

When the door 10 is in the open position (see FIGS. 1 and 2), the rollers 35 and 45 engage the surfaces 21 and 22 of the track 20 to the right of the second ramp 25 as viewed in FIG. 4. As the door 10 starts to move in direction A to the closed position (which movement may be accomplished manually or by any suitable conventional power unit), the leading roller 35 comes into operative association with the ramp 25. However due to the length 40 of the first surface 36 thereof, the first surface 36 will engage the bridge 30 so that the first roller 35 will not follow the contour of the second ramp 25, but rather will continue onwardly past the ramp 25. As movement in direction A continues, eventually leading roller 35 will approach first ramp 24 at the same time that trailing roller 45 approaches second ramp 25. Since there is no bridge at ramp 24, and due to the length 50 of the first surface 46 of trailing roller 45, roller 35 will follow the contour of ramp 24 at the same time that roller 45 is following the contour of ramp 25.

Figure 6:
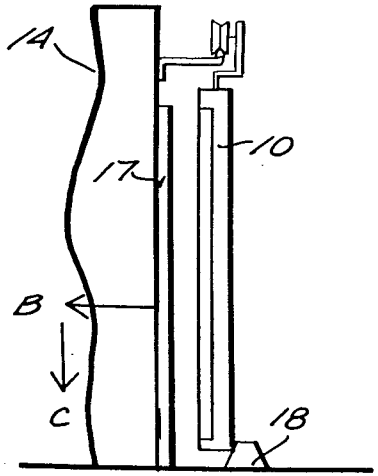

The contours of the ramps 24, 25 cause the rollers 35, 45—and the door 10 which is connected thereto—to move in both directions B and C as they continue to move in direction A, causing a downward and inward movement of the door so that the periphery 16 thereof engages the gasket 17, causing compression of the gasket 17 and thus sealing of the door (see FIG. 6).

It will thus be seen that according to the present invention a simple yet effective assembly has been provided for effecting efficient sealing action of a horizontal sliding door. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A sliding door assembly for closing an opening in a wall having a width W, comprising:

a door having a predetermined width;

means for mounting said door for sliding movement over a majority of the length of travel thereof in a first direction, and additionally for movement in second and third directions adjacent the end of travel thereof in said first direction, said second and third directions each being generally perpendicular to said first direction, and perpendicular to each other;

said mounting means including track means and a first and a second roller spaced from each other in said first direction a distance less than W, said first roller comprises a first V-shaped roller having asymmetrical first and second surface lengths, and wherein said second roller comprises a second V-shaped roller with asymmetrical first and second surface means; the asymmetry of said second roller being opposite the asymmetry of said first roller.

2. A sliding door assembly for closing an opening in a wall, comprising:

a door having a predetermined width;

means for mounting said door for sliding movement over a majority of the length of travel thereof in a first direction, and additionally for movement in second and third directions adjacent the end of travel thereof in said first direction, said second and third directions each being generally perpendicular to said first direction, and perpendicular to each other;

said mounting means including track means and roller means; and said track means including first and second surfaces elongated in said first direction and intersecting at an edge; said roller means comprising a first roller and a second roller spaced from said first roller in said first direction; said first roller having a first surface cooperating with said first surface of said track, and said second roller having a first surface cooperating with said first surface of said track; said first roller's first surface having a substantially greater length than the length of said second roller first surface.

3. A sliding door assembly for closing an opening in a wall, comprising:

a door having a predetermined width;

means for mounting said door for sliding movement over a majority of the length of travel thereof in a first direction, and additionally for movement in second and third directions adjacent the end of travel thereof in said first direction, said second and third directions each being generally perpendicular to said first direction, and perpendicular to each other;

said mounting means including track means and roller means; and said track means comprising an elongated track having first and second intersecting surfaces, said surfaces elongated in said first direction, and means defining first and second contoured ramps in said track means, at said contoured ramps said first end second track surfaces moving gradually, continuously, in both said second and third directions; and bridge means operatively associated with said track first surface and spanning said first contoured ramp to provide a continuation of said first surface at the edge of said first contoured ramp.

4. A sliding door assembly for closing an opening in a wall comprising:

a door having a predetermined width;

an elongated track disposed above said door, and elongated in a first dimension, said track having first and second intersecting surfaces elongated in said first direction, and said track having first and second contoured ramps spaced from each other in said first direction, said first and second surfaces at said contoured ramps continuously gradually moving in both second and third directions, said second and third directions each being generally perpendicular to each other, and to said first direction;

a bridge comprising a continuation of said first track surface, said bridge spanning said second contoured ramp;

first and second V-shaped rollers spaced from each other along said first direction substantially the same distance as the spacing between said first and second contoured ramps, each of said V-shaped rollers having a first surface thereof cooperating with said track first surface;

said first roller first surface having a length cooperating with said track first surface greater than the length of said second roller first surface so that said first roller first surface will engage said bridge when moving in said first direction, but said second roller first surface will not engage said bridge, but rather will follow said second contoured ramp.

5. A sliding door assembly as recited in claim 1 wherein said track means including first and second surfaces elongated in said first direction and intersecting at an edge; said first roller having a first surface cooperating with said first surface of said track, and said second roller having a first surface cooperating with said first surface of said track; said first roller's first surface having a substantially greater length than the length of said second roller first surface.

6. An assembly as recited in claim 1 wherein said first and second rollers are of identical configuration, but opposite disposition in association with said track means.

7. An assembly as recited in claim 5 wherein said track includes first and second contoured ramps, said first and second surfaces continuously gradually moving in both said second and third directions at said contoured ramps; and said track means further comprising bridge means, providing a continuation of said first track surface in said first direction, said bridge means spanning said second contoured ramp; said first roller first surface being long enough so that it engages said bridge means at said second contoured ramp when moving in said first direction, but said second roller first surface being not long enough to engage said bridge means so that said second roller follows said second contoured ramp when moving in said first direction; said first and second contoured ramps being spaced from each other in said first direction substantially the same distance as the spacing between said first and second rollers in said first direction.

8. An assembly as recited in claim 6 wherein said track includes first and second contoured ramps, said first and second surfaces continuously gradually moving in both said second and third directions at said contoured ramps; and said track means further comprising bridge means, providing a continuation of said first track surface in said first direction, said bridge means spanning said second contoured ramp; said first roller first surface being long enough so that it engages said bridge means at said second contoured ramp when moving in said first direction, but said second roller first surface being not long enough to engage said bridge means so that said second roller follows said second contoured ramp when moving in said first direction; said first and second contoured ramps being spaced from each other in said first direction substantially the same distance as the spacing between said first and second rollers in said first direction.

9. An assembly as recited in claim 1 further comprising sealing means acting between said wall and said door, said sealing means becoming operative to effect sealing only when said door moves in said second and third directions at the end of travel thereof in said first direction.

10. An assembly as recited in claim 9 wherein said first direction is horizontal, said second direction is a horizontal direction perpendicular to said first direction, and toward said wall, and said third direction is downward.

11. An assembly as recited in claim 2 wherein said first roller comprises a first V-shaped roller having asymmetrical first and second surface lengths, and wherein said second roller comprises a second V-shaped roller with asymmetrical first and second surface means; the asymmetry of said second roller being opposite the asymmetry of said first roller.

12. An assembly as recited in claim 12 wherein said first and second rollers are of identical configuration, but opposite disposition in association with said track means.

13. An assembly as recited in claim 2 wherein said track includes first and second contoured ramps, said first and second surfaces continuously gradually moving in both said second and third directions at said contoured ramps; and said track means further comprising bridge means, providing a continuation of said first track surface in said first direction, said bridge means spanning said second contoured ramp; said first roller first surface being long enough so that it engages said bridge means at said second contoured ramp when moving in said first direction, but said second roller first surface being not long enough to engage said bridge means so that said second roller follows said second contoured ramp when moving in said first direction; said first and second contoured ramps being spaced from each other in said first direction substantially the same distance as the spacing between said first and second rollers in said first direction.

14. An assembly as recited in claim 13 further comprising sealing means acting between said wall and said door, said sealing means becoming operative to effect sealing only when said door moves in said second and third directions at the end of travel thereof in said first direction; and wherein said first direction is horizontal, said second direction is a horizontal direction perpendicular to said first direction, and toward said wall, and said third direction is downward.

15. An assembly as recited in claim 14 wherein said first set of roller means comprises a first V-shaped roller having asymmetrical first and second surface lengths, and wherein said second set of roller means comprises a second V-shaped roller with asymmetrical first and second surface means; the asymmetry of said second roller being opposite the asymmetry of said first roller.

16. An assembly as recited in claim 3 wherein said first direction is horizontal, said second direction is a horizontal direction perpendicular to said first direction, and toward said wall, and said third direction is downward.

17. An assembly as recited in claim 16 further comprising sealing means acting between said wall and said door, said sealing means becoming operative to effect sealing only when said door moves in said second and third directions at the end of travel thereof in said first direction.

18. An assembly as recited in claim 4 wherein said first and second V-shaped rollers are both asymmetrical, said first roller having a longer first surface than second surface, and said second roller having a longer second surface than first surface.

19. An assembly as recited in claim 18 wherein said first and second rollers are of identical configuration, but opposite disposition in association with said track means.

* * * * *